US006425780B1

(12) United States Patent
Muhlmichel

(10) Patent No.: US 6,425,780 B1
(45) Date of Patent: Jul. 30, 2002

(54) PLUG-IN CONNECTOR WITH CABLE STRAIN RELIEF

(75) Inventor: Jurgen Muhlmichel, Pottenstein (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/618,496

(22) Filed: Jul. 18, 2000

(30) Foreign Application Priority Data

Jul. 20, 1999 (DE) ..... 199 33 834

(51) Int. Cl.[7] ..... H01R 13/58
(52) U.S. Cl. ..... 439/460; 439/595; 439/472
(58) Field of Search ..... 439/460, 463, 439/467, 595, 596, 472

(56) References Cited

U.S. PATENT DOCUMENTS 2,590,886 A * 4/1952 Pedersen ..... 439/463
3,641,482 A * 2/1972 Breting ..... 439/460
4,163,598 A * 8/1979 Bianchi et al. ..... 439/467
4,413,872 A * 11/1983 Rudy, Jr. et al. ..... 439/410
4,647,127 A * 3/1987 Weingartner ..... 439/460
4,787,864 A * 11/1988 Hunt, III et al. ..... 439/595
5,067,913 A * 11/1991 Sagawa ..... 439/595
5,122,081 A * 6/1992 Bogiel et al. ..... 439/596

FOREIGN PATENT DOCUMENTS

DE 19528234 A1 2/1997
DE 19735168 A1 3/1999
GB 0876293 * 8/1961 ..... 439/460

* cited by examiner

*Primary Examiner*—Tho D. Ta
(74) *Attorney, Agent, or Firm*—Perman & Green, LLP

(57) ABSTRACT

The invention relates to a plug-in connector having a plug housing (1), which has accommodation ducts (2) for plugs (3) which can be secured in the accommodation ducts (3) by a secondary locking device (4). The secondary locking device (4) has a web or surface (6) with which the cables (5) connected to the plugs (3) are locked to the plug housing (1) to provide strain relief.

7 Claims, 3 Drawing Sheets

PLUG-IN CONNECTOR WITH CABLE STRAIN RELIEF

BACKGROUND OF THE INVENTION

Field of the Invention

The present invention relates to a plug-in connector with cable strain relief and more particularly to a plug-in connector with a plug housing which has accommodation ducts for plugs which can be secured in the accommodation ducts by a secondary locking means. Such plug-in connectors are disclosed, for example, by DE 195 28 234 A1. In the case of this connector arrangement, a separate component, which is plugged onto he connector housing, is provided to relieve the strain on the cables emerging from the connector. An additional part with an additional function is therefore required, which likewise requires an additional operation during the handling of the connector. Therefore, both the structure and the operation or the assembly of such a connector are made more complicated.

SUMMARY OF THE INVENTION

The present invention is based on the object of developing a plug-in connector of the type outlined at the beginning in such a way that no additional component is needed for the cable strain relief function.

This object is achieved in accordance with the claim. Preferred embodiment of the present invention are identified in the subclaims.

The basic idea of the present invention resides in making additional use of the secondary locking device to clamp the cable sheaths directly or indirectly on the plug housing, in order to effect strain relief of the plugs.

BRIEF DESCRIPTION OF THE DRAWINGS

In the following text, the invention will be explained in more detail using the description of exemplary embodiments and with reference to the drawing, in which.

DETAILED DESCRIPTION OF THE INVENTION

Figure 1:
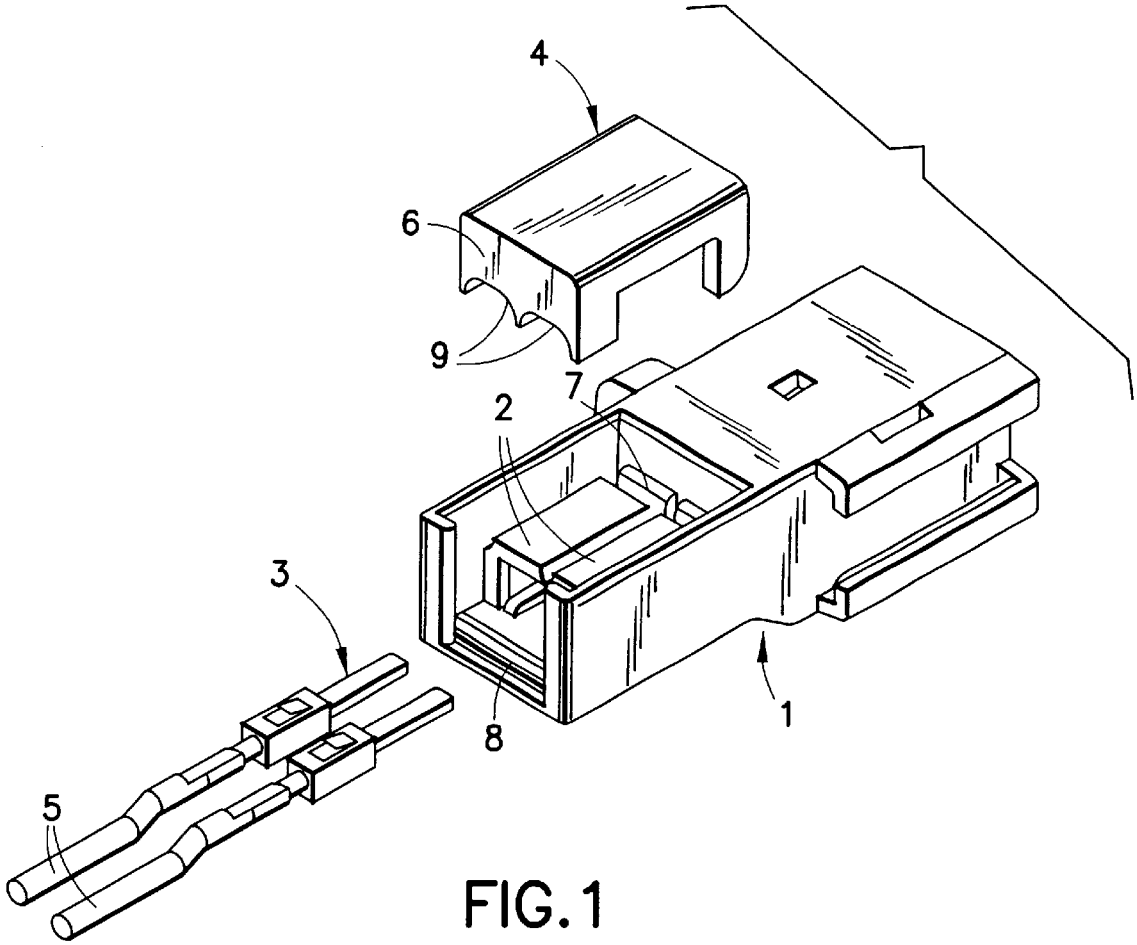
FIG. 1 shows an exploded view of a first embodiment of the plug-in connector according to the invention.

The first embodiment of the plug-in connector according to the invention has, according to FIG. 1, a plug housing 1 with accommodation ducts 2, and plugs 3 which can be secured in the accommodation ducts 2 by a secondary locking device 4. The secondary locking device 4 has a web 6 with which the cables 5 connected to the plugs 3 are locked to the plug housing for the purpose of strain relief.

The plug housing has an essentially rectangular flat shape, accommodation ducts 2 being arranged in the rear area and, in the case shown, blade plugs projecting into the front half, into the "plug-in face". The accommodation ducts 2 are arranged on the baseplate of the blade plug housing. In its rear part, the plug housing is largely open at the top and at the bottom. In that part, the secondary locking device 4 is introduced transversely with respect to the plug-in direction, and in its part pointing towards the plug-in face, locking webs or locking shoulders are provided, which engage in corresponding cutouts 7 in the accommodation ducts 2, behind a shoulder on the blade plugs 3. At the rear end of the secondary locking device, as viewed in the plug-in direction, there is provided a transverse web 6, which presses the cables 5 against the bottom 8 of the plug housing 1. In order to achieve defined clamping of the cables 5, cutouts 9 are made in the underside of the web 6, their height being somewhat less than the diameter of the cables 5, so that the latter are clamped in when the secondary locking device is latched. It is preferable for transverse ribs to be provided on the inside of the bottom 8 in the area of the clamping of the cables 5, by means of which ribs it is additionally made more difficult to pull the cable out.

Figure 2:
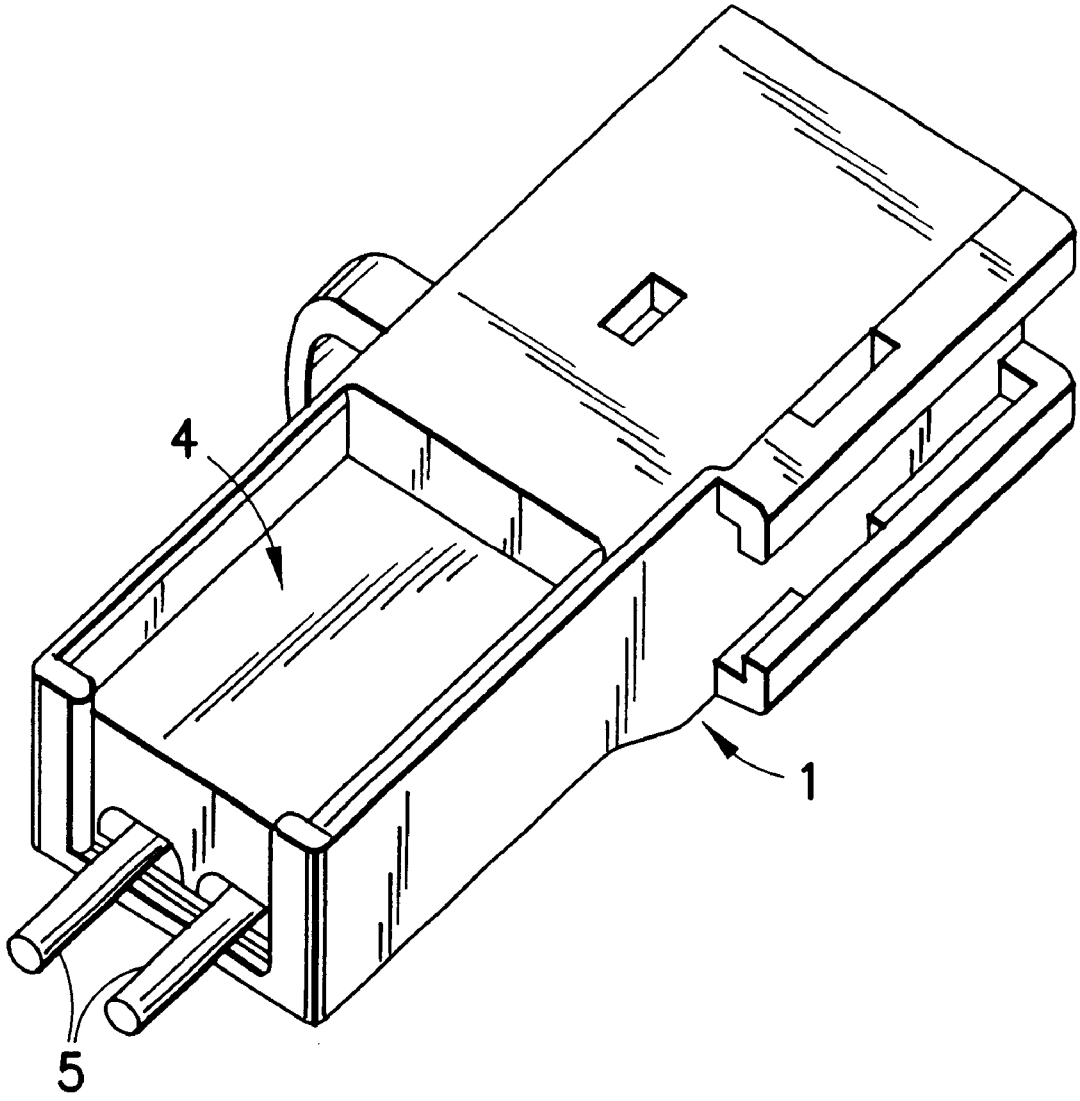
FIG. 2 shows the plug-in connector according to FIG. 1 In the assembled state and FIGS. 3*a*)–*c*) show a second embodiment of a plug-in connector according to the invention.

FIG. 2 shows this first embodiment of the present invention in the assembled state, revealing that the secondary locking device 4 constitutes the upper and lower housing cover in the rear part.

Figure 3A:
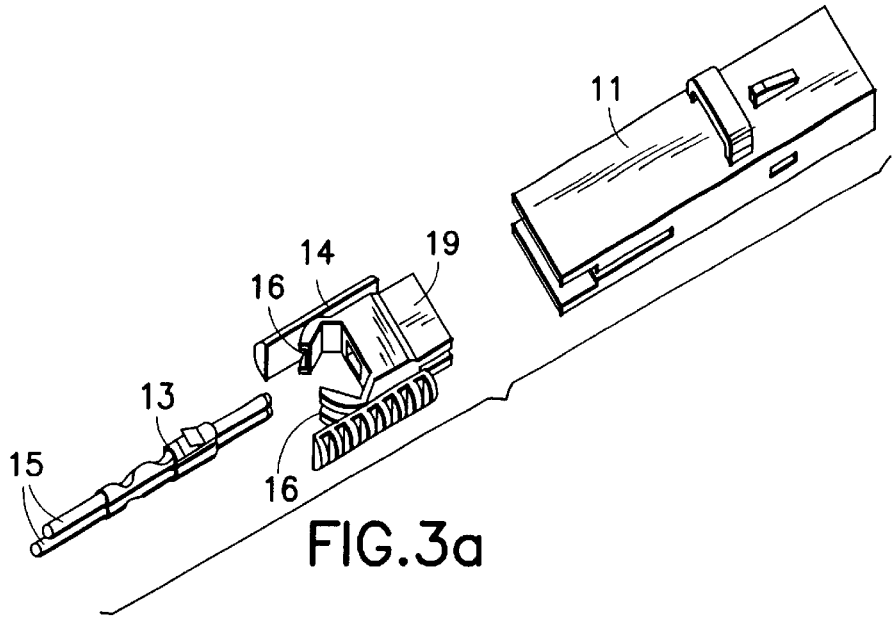
Figure 3B:
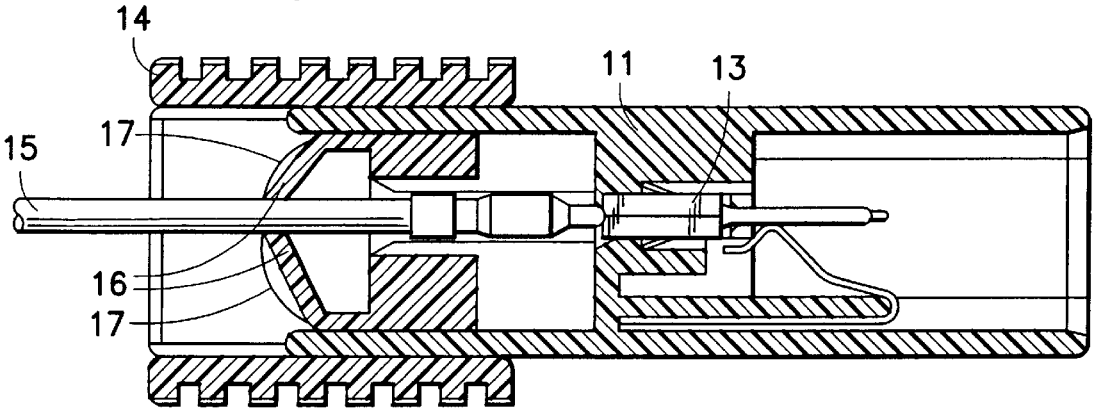
Figure 3C:
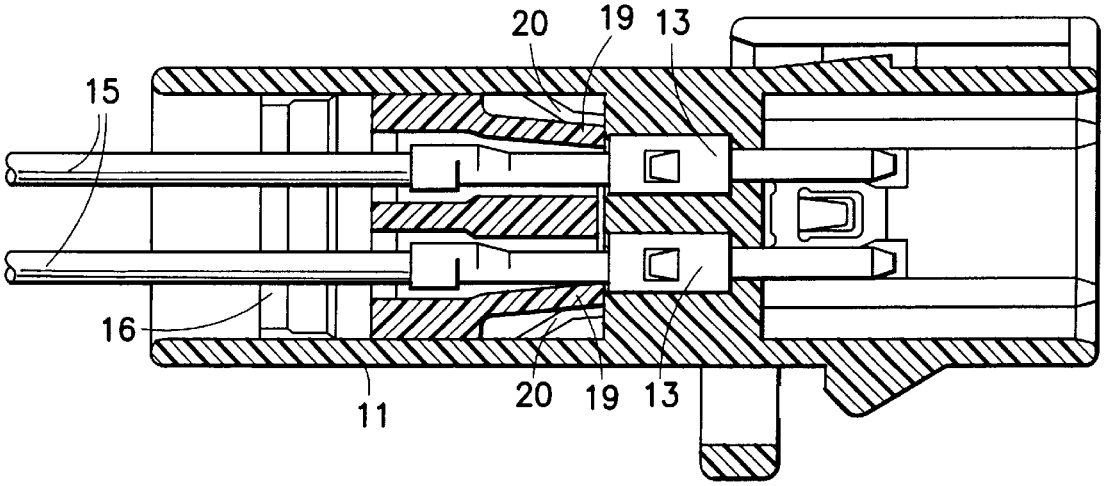

FIG. 3*a* shows the constituent parts of a second exemplary embodiment of the plug-in connector according to the invention, in which a secondary locking device 14 is pushed into the plug housing 11 coaxially with respect to the plug-in direction, the leading edges 19 (see FIG. 3*c*) being pushed behind the rear shoulders of the plugs 13, the lateral offsetting action being effected by ramps 20 which are formed in the plug housing 11. Formed at the rear ends of the secondary locking device 14 are tongs-like arms 16 whose outer sides have a rounded profile 17 which projects beyond the lateral dimensions of the secondary locking device to such an extent that when they are inserted into the plug housing 11, the arms 16, which project inwards in the manner of tongs, are pressed with their leading end onto the cables 15 from both sides, and thus hold the cable firmly as with a pair of tongs, by which means the relieving of strain on the plug 13 is effected.

Thus, here too, the secondary locking device simultaneously performs a second function, namely that of relieving the strain on the plug 13. When the secondary locking device is loosened, the "tongs" of the strain relief mechanism are opened automatically, so that the plug can be removed easily from its housing.

The exemplary embodiments explained above are used merely to explain the invention and are not to be understood as restrictive. Further variants of a combined strain-relief/secondary locking device is conceivable without departing from the idea of the invention. Thus, in the case of secondary locking device that can be inserted transversely with respect to the plug-in direction, a "tongs mechanism" similar to that shown in connection with exemplary embodiment 2 is also conceivable.

What is claimed is:

1. Plug-in connector with a plug housing, which has accommodation ducts for plugs which can be secured in the accommodation ducts via a plug-in direction by a secondary locking device wherein the secondary locking device includes a structure for allowing cables that are connected to the plugs to be locked to the plug housing to provide strain relief, the secondary locking device being arranged in the plug-in direction to be plugged onto the plug housing from the rear of the plug-in connector and, on its rear, at the level of connecting cables, having tongue-like arms which, when in a latched position come into engagement with and resiliently clamp the cable and wherein the secondary lock is adapted to relieve the strain on the cable due to a clamping fit of the tongue-like arms.

2. Plug-in connector according to claim 1, wherein said plug housing is shaped as a blade plug housing, said secondary locking device, when latched, forming one outer wall of an essentially rectangular housing.

3. Plug-in connector according to claim 1, wherein due to outwardly projecting rounded profiles on said arms, said arms are pressed against said cables when said secondary locking device is inserted into said plug housing.

4. A plug-in connector as in claim 1 wherein said arms include an outer side having a rounded profile projecting beyond the lateral dimensions of said secondary locking means to such an extent that when said arms are inserted into said plug housing said arms are pressed with their leading end onto cables from both sides whereby the relieving of strain on said plug-in connector is effected.

5. Plug-in connector having a housing comprising contact receiving cavities and having a secondary locking element slideably received on the housing between a contact unlocking position and a contact locking position, the secondary locking element comprising first interference surfaces which come into engagement with edges of contacts in the contact locking position, the secondary locking element and the housing being provided with mutually engaging surfaces located remote from the first interference surfaces, the mutually engaging surfaces forming a clamp structure which presses onto cables attached to the contacts upon engagement of the mutually engaging surfaces.

6. A plug-in connector as in claim 5, wherein said mutually engaging surfaces comprise resilient arm elements pressed against said cables when said secondary locking element is inserted into a plug housing.

7. A plug-in connector as in claim 5, wherein said mutually engaging surfaces include rear end wall elements of the plug-in connector and projecting rounded profiles projecting from said secondary lock.

* * * * *